US010214310B2

(12) United States Patent
Marcantoni

(10) Patent No.: US 10,214,310 B2
(45) Date of Patent: Feb. 26, 2019

(54) DEVICE FOR APPLYING SELF-ADHESIVE LABELS ON MOVING CONTAINERS

(71) Applicant: MAKRO LABELLING S.R.L., Goito (Mantova) (IT)

(72) Inventor: Simone Marcantoni, Ponti sul Mincio (IT)

(73) Assignee: MAKRO LABELLING S.R.L., Goito (IT)

( * ) Notice: Subject to any disclaimer, the term of this patent is extended or adjusted under 35 U.S.C. 154(b) by 194 days.

(21) Appl. No.: 15/126,129

(22) PCT Filed: Feb. 27, 2015

(86) PCT No.: PCT/IB2015/051468
§ 371 (c)(1),
(2) Date: Sep. 14, 2016

(87) PCT Pub. No.: WO2015/140655
PCT Pub. Date: Sep. 24, 2015

(65) Prior Publication Data

US 2017/0101206 A1 Apr. 13, 2017

(30) Foreign Application Priority Data

Mar. 17, 2014 (IT) ..... VR2014A0061

(51) Int. Cl.
*B65C 9/18* (2006.01)
*B65C 9/42* (2006.01)
*B65C 9/00* (2006.01)

(52) U.S. Cl.
CPC ..... *B65C 9/1869* (2013.01); *B65C 9/42* (2013.01); *B65C 2009/0084* (2013.01)

(58) Field of Classification Search
CPC .. B65C 9/1869; B65C 9/42; B65C 2009/0084
See application file for complete search history.

(56) References Cited

U.S. PATENT DOCUMENTS 4,111,121 A 9/1978 Borum
4,276,112 A 6/1981 French et al.
(Continued)

FOREIGN PATENT DOCUMENTS

EP 1619129 A1 1/2006

*Primary Examiner* — Michael N Orlando
*Assistant Examiner* — Cynthia L Schaller
(74) *Attorney, Agent, or Firm* — Pearne & Gordon LLP

(57) ABSTRACT

Described is a device (1) for applying self-adhesive labels (101) on moving containers (2), comprising means (28) for feeding a web (103) along a movement path, the labels (101) being arranged on the web (103) to bring one label (101) at a time to a detaching unit (12). The detaching unit (12) is operatively associated with the labels (101) for detaching them from the web (103) in such a way as to apply them to a container (2). The device (1) also comprises a unit for controlling the feed means (28) designed for moving the web (103) along an outward direction (19) to bring a respective label (101) to the detaching unit (12). In addition, after a label (101) has been detached, the control unit is designed to move the web (103) in a return direction (20), opposite to the outward direction, by a predetermined distance in such a way as to increase the movement space between the detaching unit (12) and the next label (101).

14 Claims, 6 Drawing Sheets

(56) References Cited

U.S. PATENT DOCUMENTS

| | | | | |
|---|---|---|---|---|
| 5,106,448 | A | 4/1992 | Freeman et al. | |
| 2009/0126866 | A1* | 5/2009 | Stenner | B65C 9/1869<br>156/235 |
| 2011/0048608 | A1 | 3/2011 | Dods et al. | |
| 2016/0368648 | A1* | 12/2016 | Pfeffer | B65C 9/42 |

* cited by examiner

DEVICE FOR APPLYING SELF-ADHESIVE LABELS ON MOVING CONTAINERS

TECHNICAL FIELD

This invention relates to a device for applying self-adhesive labels on moving containers as well as a method for applying self-adhesive labels on moving containers.

More specifically, this invention relates to the field of applying self-adhesive labels on an outer wall of bottles.

BACKGROUND ART

Usually, the bottles on which to apply the labels are positioned along the periphery of a rotary carousel operating machine, at specific plates. One or more operating units are usually present around the carousel designed for operating on the moving bottles to perform predetermined operations such as labelling, filling, application of capsules, etc.

Alternatively, the operating machine may be a machine of the linear type wherein the containers are positioned (and move) along a line (defining a transport path of the containers) which is curved or straight or a set of the two types. In this case, the operating units are positioned along the transport path of the containers.

As regards the labelling unit, it normally comprises a supporting body which extends from a first end to a second end positioned at the operating machine. Also, a prior art labelling comprises means for feeding a web along a movement path, the labels being positioned on the web. More specifically, the feed means are mounted on the supporting body and designed to bring one label at a time to the second end of the supporting body. Usually, the feed means are synchronised with the movement of the carousel in such a way as to bring the label to the bottle, when the latter has reached the second end of the supporting body.

In addition, in the prior art, the labelling unit comprises a detaching unit mounted on the second end of the supporting body and operatively associated with the labels for detaching them from the web in such a way as to bring them into contact with a container in arrival. A specific control unit controls the feed means moving the web along an outward direction in such a way as to bring a respective label to the detaching unit.

In detail, the control unit accelerates the web until the latter reaches a predetermined speed equal to the tangential speed of the container on the carrousel at the detaching unit. In effect, so that the application of the label occurs in the possible best way, the linear speed of the label must be equal to that of the bottle. After reaching the predetermined speed, the control unit controls the feed means to keep the speed constant until the label has entered into contact with the container.

After that, the control unit controls the feed means to decelerate the web until reaching a stop position (or a speed lower than the predetermined speed). In this way, when the next bottle arrives, the system is ready for a new acceleration so as to bring the next label to the bottle, and so on.

Consequently, in the prior art, it is important that the sum of the acceleration space, the deceleration space and the space at a constant speed is equal to "label step" (in this way, the starting position of the labels is the same), where the term "label step" denotes the distance between two successive label fronts of the support. In other words, the label step must include the acceleration space, the movement space at constant speed and the deceleration space.

It should be noted that the term "acceleration space" denotes the space travelled by the web during the acceleration step, the term "deceleration space" denotes the space travelled by the web during the deceleration step, and the term "space at constant speed" denotes the space travelled by the web during the step of moving at a constant speed.

In other words, the control unit is designed for performing a movement cycle for each label of the web. Each movement cycle only comprises the movement of the label along the outward direction for dispensing the label. In more detail, during each movement cycle of a respective label the movement starts from a predetermined initial position. At the end of the cycle (when the movement of the web along the outward direction is finished), the next label is in the initial position relative to the next movement cycle.

The following is provided purely by way of a non-limiting example:

label step=70 mm;
acceleration space=16 mm;
deceleration space=16 mm;
space at a constant speed=70−16−16=38 mm.

In other words, the sum of the acceleration, deceleration and constant speed spaces is equal to the length of the label step.

Consequently, if the label step is short, there are several drawbacks.

In effect, if the label step is short the acceleration and deceleration spaces reduce as it is necessary to maintain a certain space at a constant speed to allow the application of the label to the moving container.

In other words, under equal conditions of the speed of movement of the carousel (and hence of the bottle), it is necessary to reduce the acceleration and deceleration spaces. For example:

label step=20 mm;
acceleration space=8 mm;
deceleration space=8 mm;
space at a constant speed=20−8−8=4 mm.

In other words, for moving the label at the predetermined speed of the container, the feed means have available an acceleration and deceleration space which is halved relative to the previous example. This means that, at the same speed of the bottle, the acceleration with which the motor of the feed means must move the support will be four times greater than before (using a law of motion of the support with constant acceleration).

Therefore, in order to apply a very short label the control unit must deal with operating conditions which are at the limit in terms of torque requested from the motor of the means feeding the web. In addition, a fast acceleration and deceleration also results in poor treatment of the web and the mechanics.

More specifically, the greater the acceleration with which the motor moves the web, the greater will be the stresses on the drive rollers about which the web turns.

Also, it should be taken into consideration that the maximum labelling speed for a labelling unit reduces drastically if a very short label must be applied.

In addition, if two labelling units are mounted on an operating machine, one operating on a web with label step equal to 70 mm (for example) and the other operating on a web with label step equal to 20 mm (for example), the maximum production speed of the machine is limited by the maximum labelling speed which can be reached by the unit which applies the 20 mm label.

Alternatively, to overcome the above-mentioned drawbacks, it is possible to increase the label step on a web. This, however, has as a direct consequence that, with the same length of web, fewer labels are present. Consequently, the cost per label is, naturally, higher.

DISCLOSURE OF THE INVENTION

In this situation, the aim of this invention is to provide a device for applying self-adhesive labels on moving containers as well as a method for applying self-adhesive labels on moving containers which overcomes the above-mentioned drawbacks.

More specifically, the aim of this invention is to provide a device for applying self-adhesive labels on moving containers which allows operation on small size labels, reducing the stress on the machine and on the web.

Another aim of this invention to provide a device for applying self-adhesive labels on moving containers which allows operation on small size labels without limiting the maximum production speed of the operating machine.

Lastly, the aim of this invention is to provide a device for applying self-adhesive labels on moving containers which allows operation on small size labels without having to increase the label step on a web.

The aims indicated are substantially achieved by a device for applying self-adhesive labels on moving containers as well as a method for applying self-adhesive labels on moving containers as described in the appended claims.

BRIEF DESCRIPTION OF DRAWINGS

Further characteristic features and advantages of this invention will emerge more clearly from the detailed description of several preferred, but not exclusive embodiments of a device for applying self-adhesive labels on moving containers as well as a method for applying self-adhesive labels on moving containers illustrated in the accompanying drawings, in which.

DETAILED DESCRIPTION OF PREFERRED EMBODIMENTS OF THE INVENTION

Figure 1:
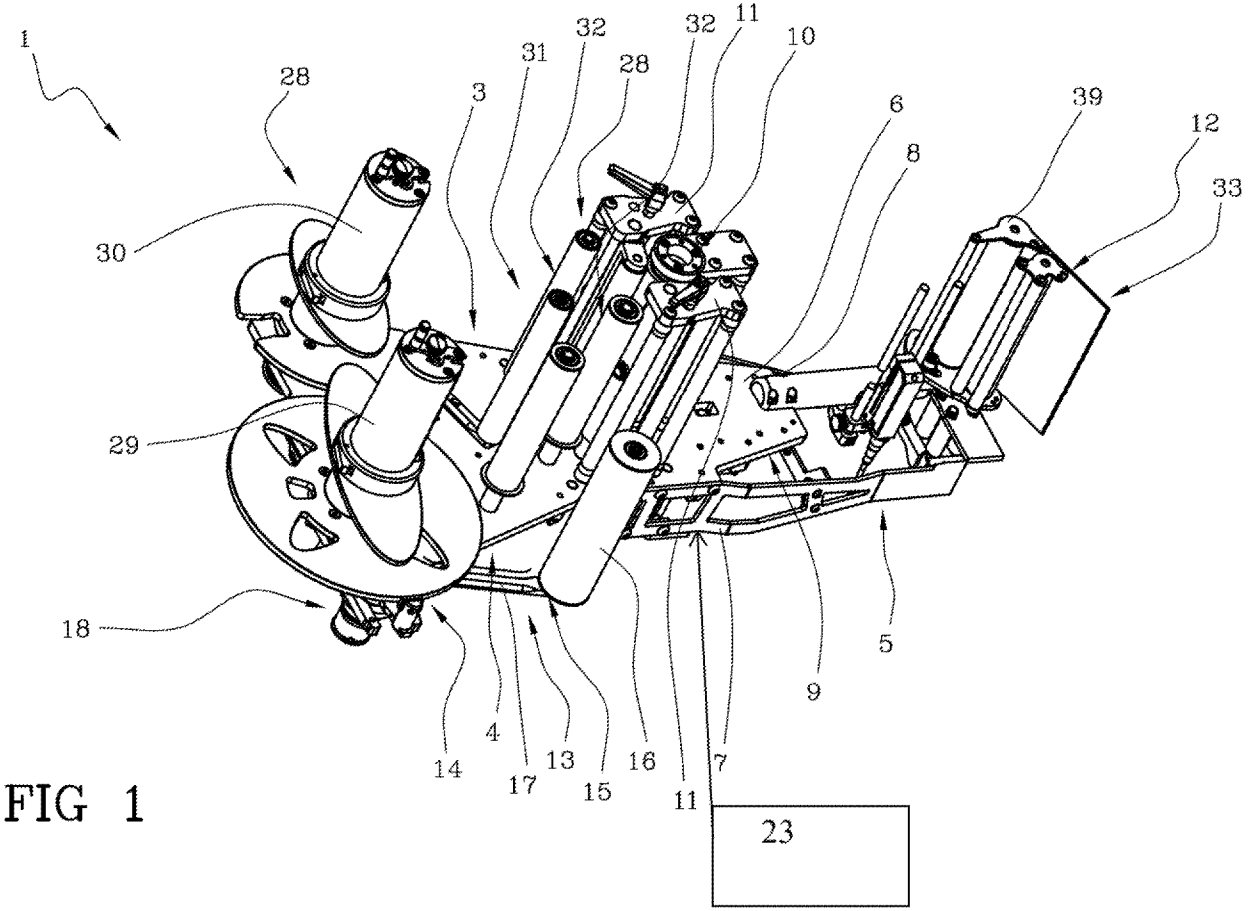
FIG. 1 is an axonometric view, with some parts cut away in order to better illustrate others, of the device for applying labels according to this invention.

With reference to the above-mentioned figures, the numeral 1 denotes in its entirety a device for applying self-adhesive labels 101 according to this invention.

The device 1 for applying self-adhesive labels 101 described below is dedicated to the application of labels 101 on the walls of containers 2 of any type. Preferably it is used in the field of bottles 2, so hereinafter reference is made to bottles 2 as an example, but without excluding the possibility that the device 1 can be applied to any other type of container 2.

The device 1 can be operatively associated with an operating machine on which, in use, the bottles 2, on which to apply the labels 101, are positioned.

The operating machine may of the rotary carousel type (curved transport path of the containers) or of the linear type (linear transport path of the containers) which can be rectilinear or comprise rectilinear stretches combined with curved stretches.

Preferably, this invention is used in relation to operating machines of the rotary carousel type and, therefore, reference will be made below mainly to that type of machine, but without excluding the use of the invention in relation to other types of operating machines (for example of the linear type).

The rotary carousel operating machines 100 are well known in the sector for processing bottles 2 and are not therefore described below in detail. The rotary carousel operating machines 100 generally comprise a carousel 100 rotatable about a rotation shaft. The bottles 2 are positioned on the periphery of the carousel 100. Each bottle 2 is usually positioned in a predetermined position on a plate, the centre of which lies on a circular line centred on the axis of rotation of the carousel 100. The movement of the carousel 100 is transmitted by a main motor connected to the rotation shaft.

The device 1 according to this invention comprises a supporting body 3 which extends from the first end 4 to a second end 5 along a direction of approach to the rotary carousel 100. In other words, the second end 5 is, in use, positioned at the rotary carousel 100.

FIG. 1 shows that the supporting body 3 is a mechanical structure which extends from a mechanical base unit (not described as of known type) towards the carousel 100.

The supporting body 3 is preferably formed by a central plate 6, a first lateral arm 7 and a second lateral arm 8. The two lateral arms 7, 8 extend from the first end 4 to the second end 5 defining laterally the supporting body 3; the central part of the supporting body 3 is formed, on the other hand, by the central plate 6. In the preferred embodiment, the central plate 6 extends from the first end 4 in the direction of the second end 5 as far as an intermediate zone 9 and not as far as the second end 5 like the lateral arms 7, 8.

Moreover, the device comprises means 28 for feeding a web 103 along a movement path, the labels 101 being arranged on the web 103. The feed means 28 are mounted on the supporting body 3 and are designed to bring one label 101 at a time to the second end 5 of the supporting body 3. Preferably, the feed means 28 comprise a sending roller 29 for storing the web 103 to be used, and a receiving roller 30 for receiving the web 103 once the labels 101 have been detached. The sending 29 and receiving 30 rollers are preferably positioned close to the first end 4 of the supporting body 3.

Figure 2:
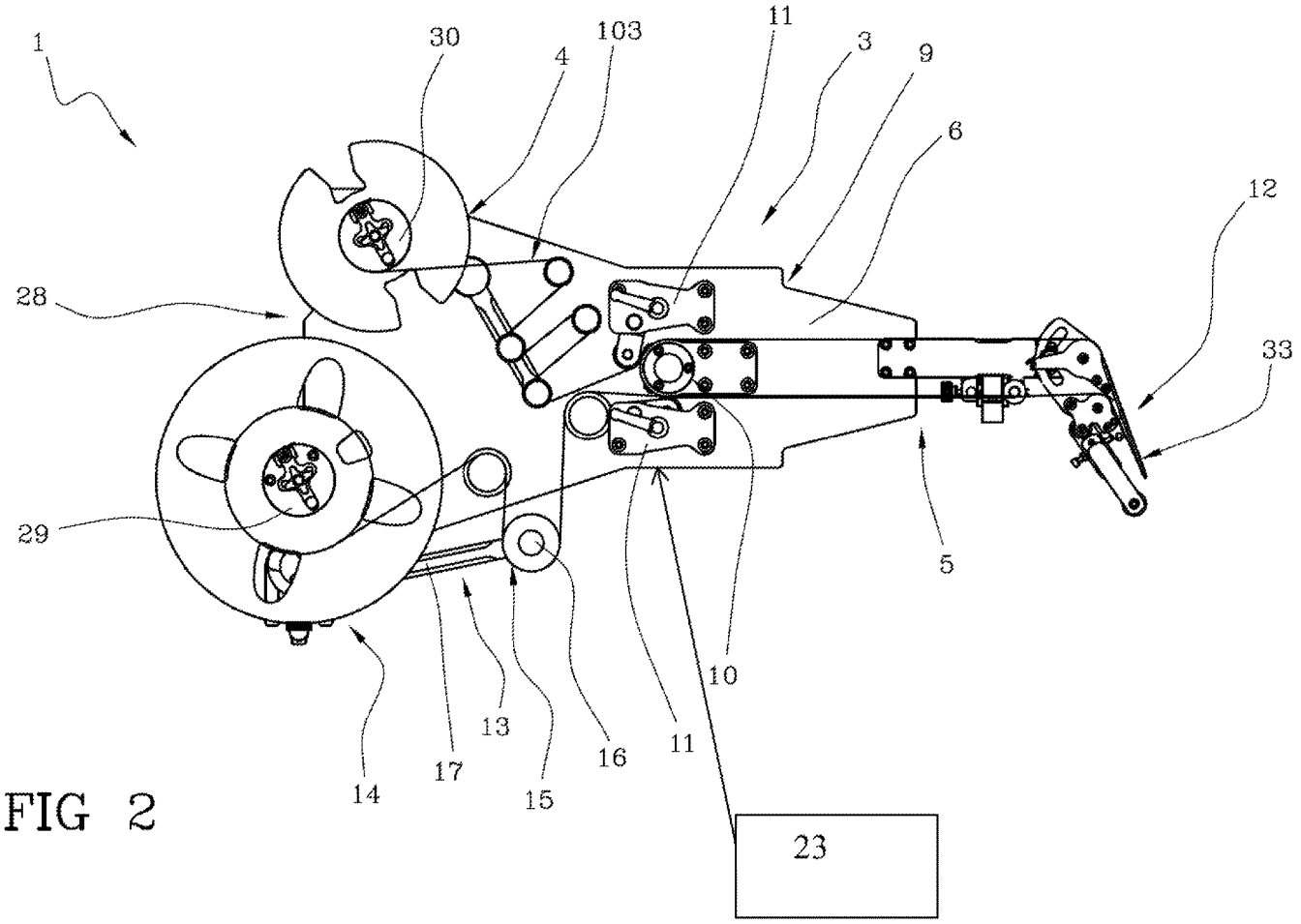
FIG. 2 is a top view of the device of FIG. 1 in a first operating configuration.
Figure 3:
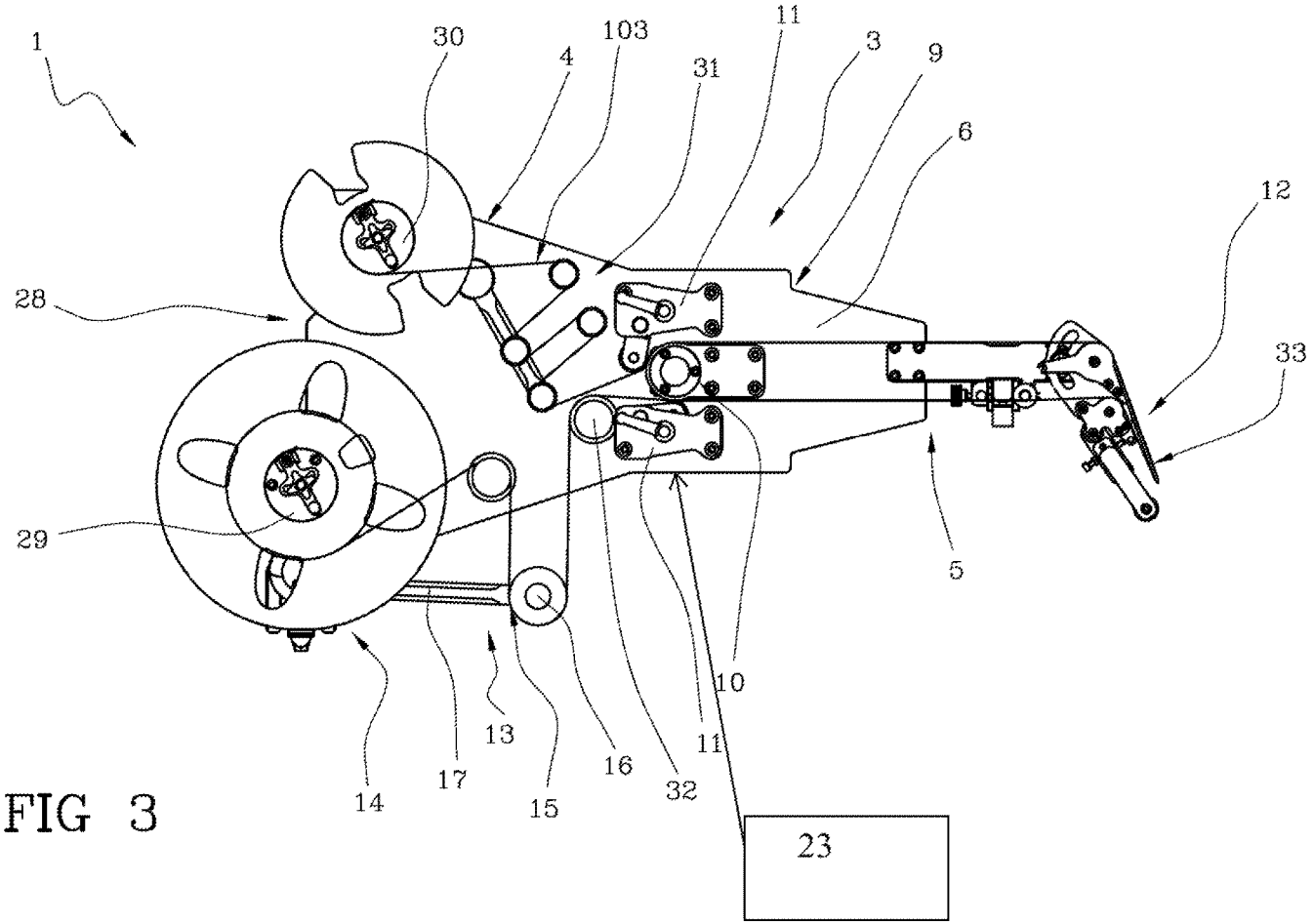
FIG. 3 is a top view of the device of FIG. 1 in a second operating configuration.
Figure 4:
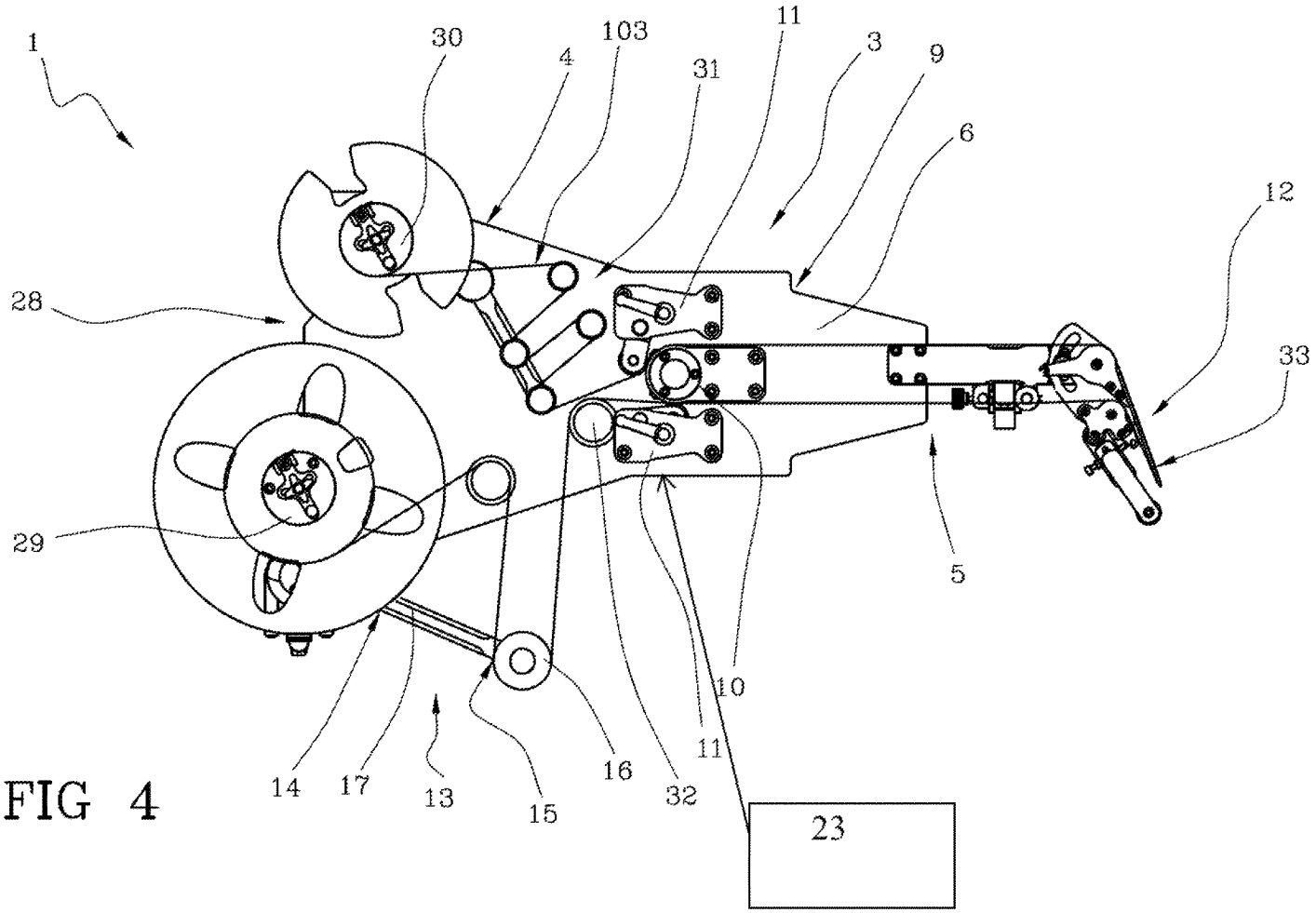
FIG. 4 is a top view of the device of FIG. 1 in a third operating configuration.

In FIGS. 2, 3, 4, the sending roller 29 is positioned at the right of the supporting body 3, whilst the receiving roller 30 is positioned at the left of the supporting body 3.

In addition, the feed means 28 comprise a central feed roller 10 positioned in contact with the outward section of the web 103 and with the return section of the web 103. The feed roller 10 is motor-driven and moves the web 103 along the movement path.

In the preferred embodiment, the fed roller 10 is positioned at the central plate 6 and projects transversely to it.

More specifically, around the feed roller 10 and parallel to it there are approach units 11 defining a close passage of the web 103 at the feed roller 10 in such a way that the web 103 adheres to it for the feeding. Preferably, the approach units 11 are defined by rollers and/or panels positioned parallel to the feed roller 10 at two opposite sides of the latter in such a way as to define a passage of the outward section of the web 103 and a passage of the return section of the web 103.

The feed means 28 are synchronised with the movement of the carousel 100 in such a way that each label 101 is moved to the second end 5 when the container 2 reaches the second end 5.

In some cases (especially in the case of movement of the web 103 at high speeds), the receiving roller 30 is motor-driven so as to favour the re-winding of the web 103.

The sending roller 29 is preferably idle. In addition or alternatively, the sending roller 29 is at least partly braked to keep the web 103 in tension along the movement path.

Moreover, the device comprises a detaching unit 12 mounted on the second end 5 of the supporting body 3 and operatively associated with the labels 101 for detaching them from the web 103 in such a way as to bring them into contact with a container 2.

In other words, the web 103 follows a movement path from the sending roller 29 to the detaching unit 12 and, lastly, towards the receiving roller 30. In other words, the movement path of the web 103 passes the detaching unit 12 for releasing the labels 101. In practice, in the stretch of web 103 between the sending roller 29 and the detaching unit 12 the labels 101 are attached to the web 103, whilst in the stretch of web 103 between the detaching unit 12 and the receiving roller 30 no labels 101 applied to the web 103.

Preferably, the device comprises guide means 31 positioned along the movement path for guiding the web 103 from the sending roller 29 to the detaching unit 12 and from the detaching unit 12 to the receiving roller 30. The guide means 31 guide the web 103 towards the detaching unit 12 and in particular to the detaching unit 12. Preferably, the guide means 31 are formed, at least for the most part, by guide rollers 32 mounted in an idle fashion on the supporting body 3. Each of these guide rollers 32 has an axis of rotation substantially transversal to the main direction of extension of the supporting body 3.

It should be noted that the guide means 31 comprise a tensioning unit 13 extending between a relative first end 14 rotatably mounted on the supporting body 3 and a relative second end 15 forming a guide of the web 103. The tensioning unit 13 preferably comprises a dandy roller 16 and a rod 17. The rod 17 extends between the supporting body 3 and the dandy roller 16 about which the web 103 is wound.

Also, the tensioning unit 13 comprises an elastic device (for example, a spring) operatively connected between the supporting body 3 and the tensioning rod 17 and designed to keep the dandy roller 16 pressed against the web 103 partly wound on it. In this way, the tensioning unit 13 makes it possible to keep the web 103 in tension along the movement path.

FIGS. 2, 3 and 4 show three respective positions of the dandy roller 16 which correspond, respectively, to a position of maximum tensioning of the web 103, medium tensioning of the web 103 and minimum tensioning of the web 103. In FIG. 2 the rod 17 is in a position close to the supporting body 3 and, in this situation, the elastic device is very compressed, meaning that the web 103 is in a condition of maximum tensioning. In FIG. 4, the rod 17 is further away from the supporting body 3 and, in this situation, the elastic device is only slightly compressed, meaning that the web 103 is in a condition of minimum tensioning.

Preferably, the tensioning unit 13 is operatively connected to a device 18 for braking the sending roller 29 and it is designed to slow down the sending roller 29 more when the web 103 is in a condition of minimum tensioning. In the embodiment illustrated in the accompanying drawings, if the dandy roller 16 of the tensioning unit 13 is in the position furthest from the supporting body 3, the sending roller 29 is in a condition of maximum braking; whilst if the dandy roller 16 of the tensioning unit 13 is in the position closest to the supporting body 3, the sending roller 29 is in a condition of minimum braking.

Moreover, the detaching unit 12 preferably comprises an inversion plate 33 comprising a first surface 34 and a second surface 35 which are opposite to one another and form part of the movement path of the web 103. The inversion plate 33 comprises a detaching edge 36 positioned between the first surface 34 and the second surface 35 for causing the release of each label 101 as the web 103 passes from the first surface 34 to the second surface 35.

More specifically, the inversion plate 33 is connected to the supporting body 3 at the second end 5. Preferably, the inversion plate 33 has a first part 37 connected to the supporting body 3 and a second part 38 protruding from it and close to the carousel 100. The detaching edge 36 is part of the second part 38 of the inversion plate 33 and allows the release of the labels 101 towards the bottle 2.

The inversion plate 33 is preferably connected to the supporting body 3 by an extension of the supporting body 3 at the second end 5.

In addition, the embodiment illustrated in the accompanying drawings shows that the outward surface 34 of the inversion plate 33 is connected to a fin 39 transversal to the first surface 34.

The device 1 also comprises means 40 of adjusting the inversion plate 33 for adjusting the position of the inversion plate 33 on the supporting body 3. In the preferred embodiment illustrated in FIG. 1 the adjustment means 40 comprise an elongate hole 41 having a curved profile on the fin 39; and at least one screw 42 passing, in use, in the elongate hole 41 and screwed into the supporting body 3. The hole 41 extends between an end of maximum protrusion 43 and an end of minimum protrusion 44.

In this way, the adjustment means 40 allow the position of the inversion plate 33 to be adjusted between a position of maximum protrusion wherein the screw 42 is fixed in a position close to the end of maximum protrusion 43 (in which the detaching edge 36 protrudes fully relative to the supporting body 3), and a position of minimum protrusion wherein the screw 42 is fixed in a position close to the end of minimum protrusion 44.

The web 103 releases the labels 101 in moving from the first surface 34 to the second surface 35 at the detaching edge 36. In this movement each label 101 detaches from the web 103 and moves towards a moving container 2.

More specifically, the device comprises a unit for controlling the feed means 28 designed for moving the web 103 along an outward direction 19 in such a way as to bring a respective label 101 to the detaching unit 12. In other words, the outward direction 19 is the direction which allows the labels 101 to be transported from the sending roller 29 to the detaching unit 12 and to the receiving roller 30.

Preferably, the control unit 23 is designed for moving the web 103 along an outward direction 19 for a movement space greater than or equal to the label step 21. More specifically, if the movement space is greater than the label step 21 described below this is linked to the fact that the predetermined distance determines a more withdrawn position relative to the starting position of a label 101 according to the prior art.

In other words, the control unit is designed for performing a movement cycle for each label 101 of the web 103. Each movement cycle comprises the movement of the label 101 along the outward direction 19 for dispensing the label 101. In more detail, during each movement cycle of a respective label 101 the movement starts from a predetermined initial position. At the end of the cycle, the next label 101 is in the initial position relative to the next movement cycle.

It should be noted that the control unit is designed to manage a motor of the feed roller 10 in such a way as to control the movement of the web 103. The winding of the web 103 around the receiving roller 30 and the unwinding of the web 103 from the sending roller 29 defines a movement of the web 103 along the outward direction 19.

In detail, the control unit is designed to manage the movement of the web 103 in synchrony with the movement of the containers 2 on the carousel 100 in such a way that the label 101 is dispensed when a container 2 passes the detaching unit 12.

Moreover, the control unit is designed for moving the web 103 until the latter reaches a predetermined speed equal to the speed of movement of a container 2 at the detaching unit 12. In this way, the detaching unit 12 detaches the label 101 whilst a moving container 2 passes. In the preferred embodiment, the predetermined speed is a constant speed in such a way that both the web 103 and the container 2 move for a stretch of space for applying the label 101 at an equal and constant speed. Alternatively, the predetermined speed could comprise a component of acceleration or deceleration.

Preferably, the control unit for the feed means 28 is designed for:

- moving the web 103 in the outward direction 19, accelerating it in such a way as to bring it up to the predetermined speed;
- keeping the web 103 moving at the predetermined speed for the stretch of space for application of the label 101;
- moving the web 103 in the outward direction 19 whilst decelerating in such a way as to bring it to a null speed.

The sum of the acceleration space, the space at the predetermined speed and the deceleration space is equal to a label step 21.

Alternatively, the control unit for the feed means 28 is also designed to keep the web 103 stationary waiting for the arrival of the next container 2 after the movement of the web 103 whilst decelerating.

According to this invention, after a label 101 has been detached, the control unit is designed to move the web 103 in a return direction 20, opposite to the outward direction 19, by a predetermined distance in such a way as to increase the movement space between the detaching unit 12 and the next label 101.

In particular, the control unit is designed to withdraw the web 103 relative to the position adopted following the detachment of the final label 101 and the subsequent deceleration of the web 103. In other words, the control unit is designed to withdraw the web 103 at the end of the deceleration of the latter.

Advantageously, the withdrawal of the web 103 makes it possible to increase the space between the front of the next label 101 and the detaching unit 12 relative to the stop position after the deceleration of the web 103. Consequently, the predetermined distance allows a subsequent acceleration of the web 103 to be made for applying the label 101 with an acceleration ramp having an inclination less than that of the prior art for reaching the predetermined speed. In other words, the predetermined distance allows a subsequent acceleration of the web 103 to be made for applying the label 101 with longer times (with a more gradual ramp) that of the prior art for reaching the predetermined speed.

In other words, the predetermined distance defines the acceleration ramp space gained relative to the position of the web 103 at the end of movement whilst decelerating.

It should be noted that the predetermined distance represents the excess web 103 unwound relative to the label step 21.

With reference to each movement cycle described above, it should be noted that each cycle comprises the movement of the label 101 along the outward direction 19 and the movement of the label 101 along the return direction 20. In other words, at the end of the movement of the label 101 along the outward direction 19, the next label 101 is not in the initial position (as in the case in the prior art), and it is only in the initial position at the end of the movement of the label 101 along the return direction 20.

More specifically, the control unit for the feed means 28 is designed for:

- moving the web 103 in the outward direction 19, accelerating it in such a way as to bring it up to the predetermined speed;
- keeping the web 103 at a constant speed for a stretch of space for application of the label 101;
- moving the web 103 in the outward direction 19 whilst decelerating in such a way as to bring it to a null speed;
- moving the web 103 in the return direction 20 for the predetermined distance.

Alternatively, the control unit is also designed for stopping the web 103 whilst waiting for the arrival of the next container 2 after the movement of the web 103 whilst decelerating along the outward direction 19 and/or after the movement of the web 103 along the return direction 20.

More specifically, the control unit for the feed means 28 is designed to move the web 103 in the outward direction 19 in an outward time and to move the web 103 in the return direction (20) in a return time.

The sum of the outward time and the return time is less than or equal to a predetermined machine step time, where the term "machine step 22" means the period of time between the passage of one container 2 and a container consecutive to it at the detaching unit 12.

More specifically, the control unit for the feed means 28 is designed to keep the web 103 stationary for a predetermined stationary time. The sum of the outward time, the return time and the stationary time is equal to the predetermined machine step time.

It should also be noted that the movement space of the web 103 (and therefore a label 101) corresponds to a relative machine step space 22. The machine step space 22 is defined as the space on the machine (between one container and the next) occupied by the movement of the web 103 since the machine moves relative to the web 103. For example, the acceleration space of the web 103 corresponds to a first portion of machine step space 22. The movement space at the predetermined speed of the web 103 corresponds to a second portion of machine step space 22 which follows the first. The movement space of the web 103 whilst decelerating corresponds to a third portion of machine step space 22 which follows the second. The movement space of the web 103 along the predetermined distance corresponds to a fourth portion of machine step space 22 which follows the third.

In this way, the sum of the machine space portions corresponding to the acceleration, predetermined speed, deceleration and predetermined distance spaces of the web 103 is less than or equal to a machine step 22. Also, if the web 103 is kept stationary for a predetermined stationary time (step not necessary, but possible), the stationary time corresponds to a fifth portion of machine step space 22 which follows the fourth or interposed between the second and the third (after the deceleration of the web 103).

In this case, the sum of the machine space portions corresponding to the acceleration, predetermined speed, deceleration, predetermined distance and stationary time spaces of the web 103 is equal to a machine step 22.

Precisely, this equality should be considered for a predetermined motion relationship between the movement of the containers 2 and the movement of the labels 101 of the web 103.

More specifically, the movement of the containers 2 and the movement of the web 103 is generated by two respective drive means which are separate from and synchronised with each other or by a single drive means connected to both the operating machine and the device 1 by suitable transmission means. In the first case, the motion relationship is determined by a predetermined synchronisation ratio between the two drive means. In the second case, the predetermined motion relationship is determined by the transmission ratio of the transmission means (for example, by the shape of a cam forming part of the transmission means).

Advantageously, the control unit for the feed means 28 is designed to determine the acceleration and deceleration spaces or ramps as a function of the technical features of the device (for example, maximum torque of the motor-driven feed roller 10 and/or mechanical structure of the guide means 31 and/or others) and/or of the features of the web 103. In this way, once the acceleration and deceleration spaces or ramps are determined, the control unit for the feed means 28 is designed for calculating the predetermined distance along which the web 103 moves along the return direction 20.

More in detail, the predetermined distance is calculated as the difference between the label step 21 and the acceleration, predetermined speed and deceleration spaces.

The algebraic sum of the distances travelled by the web 103 for the dispensing of each label is equal to the label step 21 in such a way as to guarantee that the starting position of the label 101 is always the same.

For example, it is possible to consider the following numeral example:

machine step 22=150 mm;
label step 21=20 mm;
acceleration space=16 mm;
predetermined speed space=4 mm;
deceleration space=16 mm;
space to recover returning take the web 103 of the predetermined distance=16+16+4−20=16 mm In this case, and in general, it is evident that the sum of the movement space during acceleration along the outward direction 19 and the movement space whilst decelerating along the outward direction 19 may also be equal to or greater than a label step 21 whilst in the prior art it was not possible as the predetermined distance along a return direction 20 was not generated.

Also, if the acceleration and deceleration of the web 103 (and hence of the label 101) are defined by a constant value (they are constant), and considering that the containers 2 move on the operating machine at a constant speed, the ratio between the movement space of the label 101 the movement space of the container 2 is ½. For example, for moving label 101 by 16 mm whilst accelerating (or decelerating) 2×16 mm of space is necessary for moving the container 2. With reference to the above-mentioned example:

machine step portion in which the label 101 moves at the predetermined speed=4 mm
machine step portion in which the label 101 accelerates=16×2=32 mm
machine step portion in which the label 101 decelerates=16×2=32 mm
machine step portion in which the label 101 moves backwards=16×2=32 mm
machine step portion in which the label 101 remains stationary=150−32−32−32−4=50 mm.

It should be noted that the change in direction of the movement of the web 103 (from outward direction 19 to return direction 20 and vice versa) is advantageously absorbed by the tensioning unit 13 and, in particular, by the movement of the dandy roller 16 as described above.

Preferably, the control unit is designed for accelerating the web 103 along the return direction 20 and, subsequently, for decelerating the web 103 along the return direction 20. More specifically, the sum of the acceleration space of the web 103 along the return direction 20 and the deceleration space of the web 103 along the return direction 20 (and, if necessary, the movement space of the web 103 at a constant speed along the return direction 20) defines the predetermined distance.

This invention also relates to an operating machine for processing containers 2. More specifically, the operating machine comprises means for feeding the containers along a movement path. In addition, the operating machine comprises a labelling unit positioned at a stretch of the container movement path and operatively associated with the feed means for applying labels 101 to the moving containers 2. More specifically, the labelling unit comprises the device for applying self-adhesive labels 101 as described above, the features of which are incorporated here in their entirety.

Figure 5:
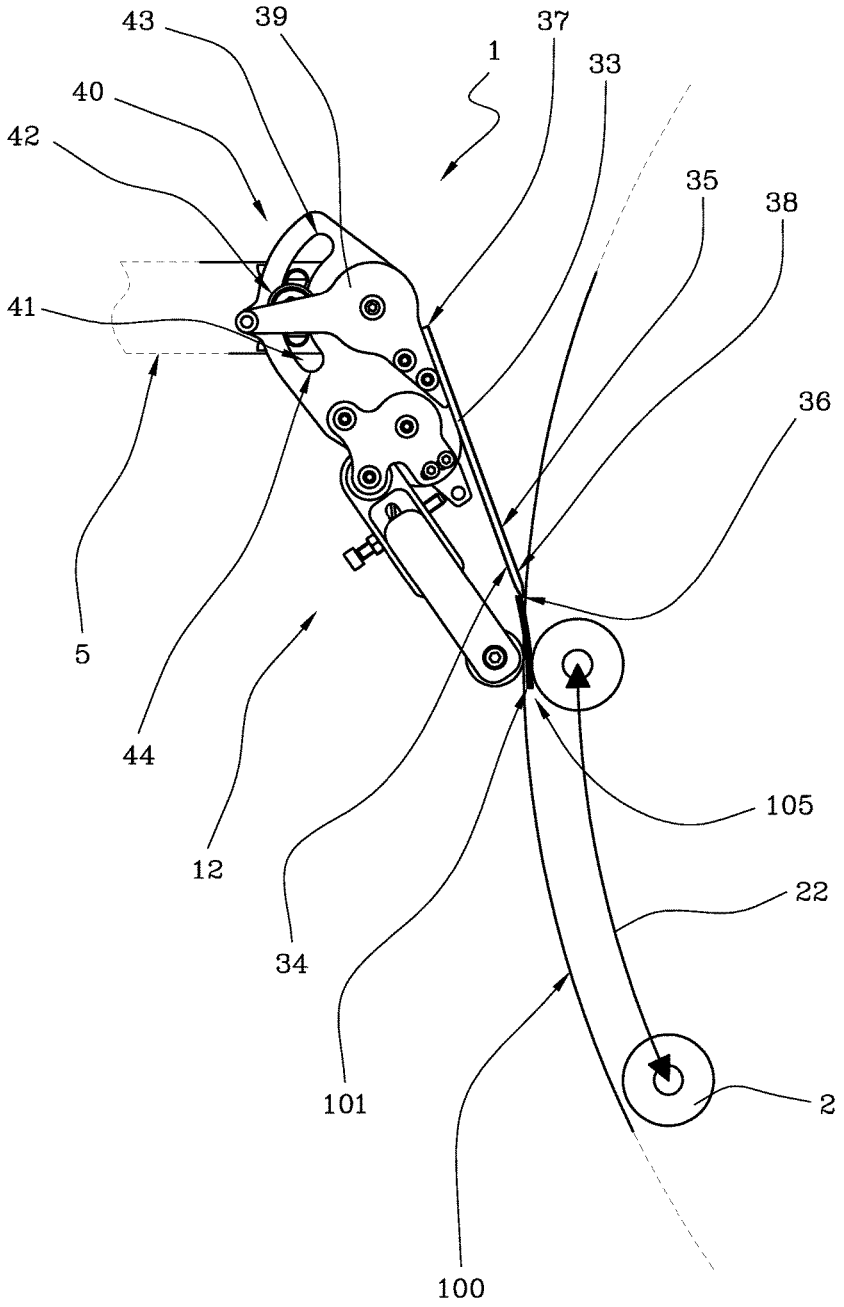
FIG. 5 is a schematic top view of a part of the device of FIG. 1 associated with a carousel of an operating machine.
Figure 6:
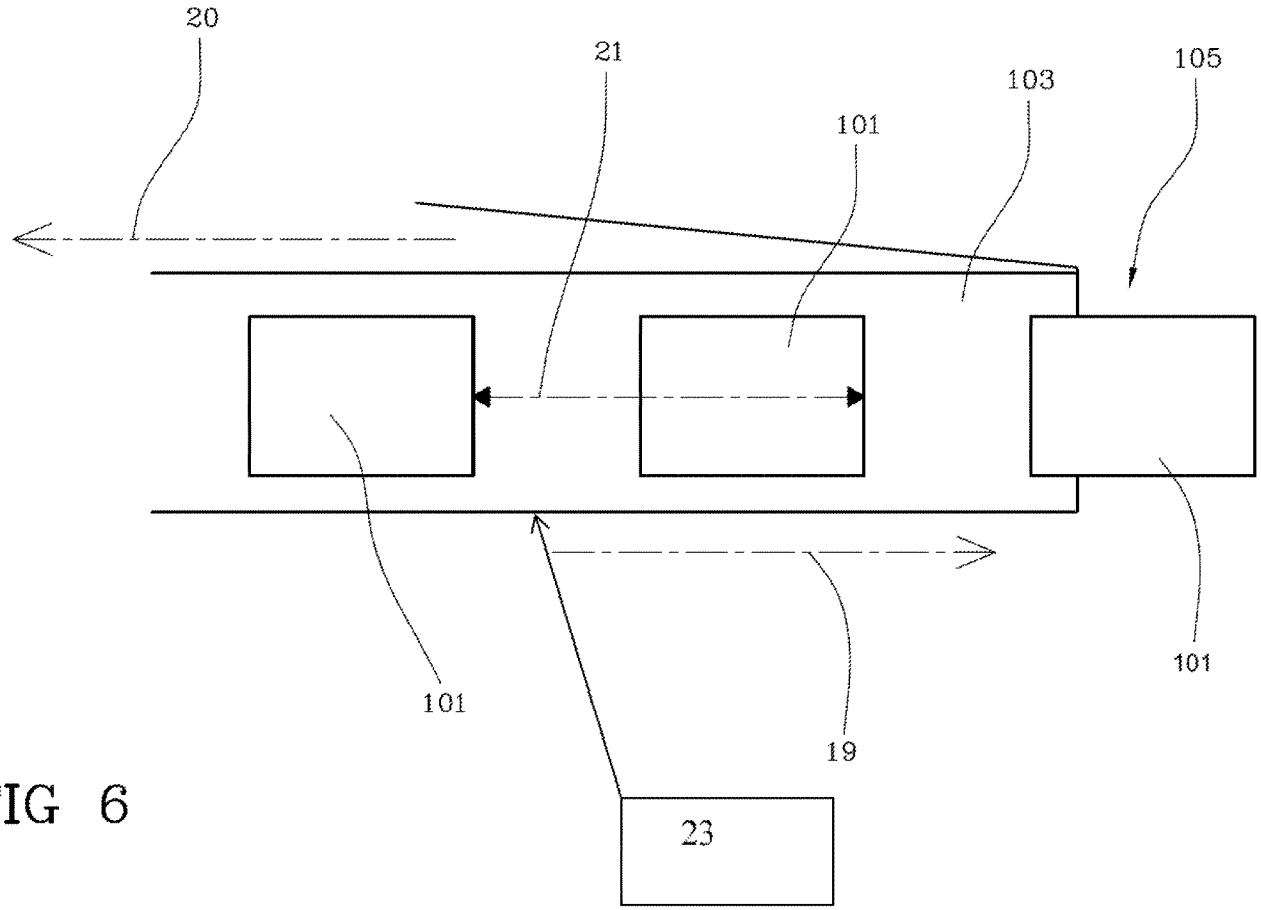
FIG. 6 is a schematic top view of a web on which the labels to be applied are positioned according to this invention.

In the preferred embodiment, the machine is of the rotary carousel type 100 and the feed means are defined by the rotary carousel 100. More in detail, the rotary carousel 100 has a plurality of stations located along the periphery of the rotary carousel 100 for positioning the respective containers 2 to be processed. FIG. 5 shows a portion of the rotary carousel 100 where it is possible to see the containers 2 positioned along the periphery.

In this case, the labelling unit is positioned at a stretch of the periphery of the rotary carousel 100 and it is operatively associated with the rotary carousel 100 for applying labels 101 to the moving containers 2. The labelling unit comprises the device for applying self-adhesive labels 101 of the type described previously. Consequently, all the features described above relative to the labelling device are incorporated here in relation to the operating machine.

Also, this invention relates to a method for applying self-adhesive labels 101 on the containers 2 moving on the operating machine of the rotary carousel type 100. More specifically, the method is derived directly from what is described above for the device and for the machine which is incorporated here in its entirety.

More in detail, the method comprises a first operating step for feeding the web 103 on which the labels 101 are positioned along the outward direction 19 of the movement path in such a way as to bring one label 101 at a time to a detaching zone 105. The detaching zone 105 is positioned at the detaching unit 12.

The step of moving the web 103 comprises accelerating the web 103 until reaching the predetermined speed and keeping it at the predetermined speed for a predetermined space for application of the label 101 corresponding to the above-mentioned predetermined distance. As already mentioned, the predetermined speed is equal to the moving speed of a container 2 at the detaching zone 105.

Then, the method comprises a step of detaching the label 101 at the detaching unit 12 and synchronised with the arrival of a container 2 at the latter in such a way as to apply the label 101 to the container 2. The step of detaching the label 101 occurs during the movement of the web 103 at the same speed of feeding the containers 2 (predetermined speed) in such a way as to obtain an optimum and uniform application of the label 101 on the container 2.

In addition, following the step of moving the web 103 at a predetermined speed, the method comprises decelerating the web 103 to null speed. In other words, after the step of moving the web 103 at a predetermined speed the web 103 is slowed down and stopped.

According to the method according to this invention, following the step of decelerating the web 103 until it reaches null speed, there is a step of moving the web 103 in a return direction 20, opposite to the outward direction, by the predetermined distance in such a way as to increase the movement space between the next label 101 and the detaching unit. In this way, the predetermined distance makes it possible to increase the space for applying the next label 101 since the space for the relative acceleration, moving at predetermined speed and deceleration steps is increased.

Advantageously, in this way, the mechanical stresses on the guide and feeding components of the web 103 and the stresses on the web 103 are reduced.

Preferably, after the step of moving the web 103 along the return direction 20 for the predetermined distance and/or after the step of moving the web 103 along the outward direction 19, the method comprises a subsequent step of stopping the web 103 and keeping it stationary in position waiting for the next container 2.

It should be noted that the sum of the duration of the step of moving the web 103 in the outward direction 19 and the duration of the step of moving the web 103 in the return direction 20 is equal to the predetermined machine step time and equal to the period of time between the passage of one container 2 and a container consecutive to it at the detaching zone 105.

Preferably, during the step of moving the web 103 along the return direction 20, the method comprises accelerating the web 103 and, subsequently, decelerating the web 103. More specifically, the sum of the acceleration space of the web 103 along the return direction 20 and the deceleration space of the web 103 along the return direction 20 (and, if necessary, the movement space of the web 103 at a constant speed along the return direction 20) defines the predetermined distance.

The invention achieves the preset aims.

More specifically, this invention provides a device for applying self-adhesive labels of any size and, in particular, with narrow dimensions, reducing the stress on the machine and on the web.

In effect, the movement of the web along the return direction allows an additional space to be recovered and to have more gradual accelerations and decelerations for applying the next label.

In this way, the device allows operation on small size labels without limiting the maximum production speed of the operating machine. In effect, the reduction in the stresses on the machine and on the web makes it possible to raise the maximum speed of labelling in such a way as to not limit the maximum production speed of the operating machine.

Lastly, the invention makes it possible to operate on small sized labels without having to increase the label step on a web since the movement along the return direction makes it possible to recover the spaces for applying each label irrespective of the label step on the web.

It should also be noted that this invention is relatively easy to implement and that the cost of implementing the invention is relatively low as it is an implementation of control on the control unit of the means of feeding the web.

The invention claimed is:

1. A device for applying self-adhesive labels (101) on moving containers (2) on a machine, said device being associable with the machine on which the containers (2) are, in use, positioned; the device comprising:

a supporting body (3) extending from a first end (4) to a second end (5) which is, in use, positioned at the machine;

feed means (28) for feeding a web (103) along a movement path, the labels (101) being arranged on the web (103); said feed means (28) being mounted on the supporting body (3) and configured to bring one label (101) at a time to the second end (5) of the supporting body (3); said feed means (28) being synchronisable with the movement of the containers (2) on the machine;

a detaching unit (12) mounted on the second end (5) of the supporting body (3) and operatively associated with the labels (101) for detaching them from the web (103) in such a way as to bring them into contact with a container (2);

a control unit (23) for the feed means (28) configured and programmed to move the web (103) in an outward direction (19) in such a way as to bring a respective label (101) to the detaching unit (12); said control unit (23) being configured and programmed to move the web (103) until the web reaches a predetermined speed in the outward direction (19), substantially equal to a speed of movement of a container (2) at the detaching unit (12), in such a way that the latter detaching unit (12) detaches the label (101) when the moving container (2) passes by the detaching unit (12);

characterised in that the control unit (23) is configured and programmed to control the web (103) and labels (101) in a continuing series of movement cycles wherein, at a beginning of a first movement cycle, a front of a first label (101) on the web (103) is provided at a predetermined initial position which is in register with the containers (2) on the machine and in the first movement cycle the front of the first label (101) starts from the predetermined initial position and at the end of the first movement cycle a front of a next label is located at the predetermined initial position, the control unit (23) being further configured and programmed so that, after a first label (101) has been detached, the front of the next label (101) on the web (103) is moved in a return direction (20), opposite to the outward direction (19), by a preselected distance from the predetermined initial position, wherein the movement of the front of the next label (101) in the return direction (20) increases a movement space between the front of the next label (101) and the detatchinq zone (105) by a predetermined amount, wherein the preselected distance from the predetermined initial position is a distance which is effective to (a) reduce a maximum acceleration of the next label (101) to the detaching zone (105) below a preselected amount, or (b) reduce a maximum deceleration of the web (103), after the next label (101) is detached, below a preselected amount, or (c) both (a) and (b).

2. The device according to claim 1, characterised in that the control unit (23) for the feed means (28) is configured and programmed for:

moving the web (103) in the outward direction (19), accelerating it in such a way as to bring it up to the predetermined speed;

keeping the web (103) moving at the predetermined speed for a stretch of space for application of the label (101) on the container (2);

moving the web (103) in the outward direction (19), decelerating it in such a way as to bring it to a null speed;

moving the web (103) in the return direction (20) for the preselected distance.

3. The device according to claim 1, characterised in that the control unit (23) for the feed means (28) is designed to move the web (103) in the outward direction (19) in an outward time and to move the web (103) in the return direction (20) in a return time; the sum of the outward time and of the return time being less than or equal to a predetermined machine step time and less than or equal to period of time between the passage of one container (2) and a container consecutive to it at the detaching unit (12).

4. The device according to claim 3, characterised in that the control unit (23) for the feed means (28) is designed to keep the web (103) stationary for a predetermined stationary time after the end of the movement of the web (103) in the outward direction (19) and/or after the movement of the web (103) in the return direction (20); the sum of the outward time, the return time and the stationary time being equal to said predetermined machine step time.

5. The device according to claim 2, characterised in that the sum of a movement space in the outward direction (19) and a movement space in the return direction (20) is equal to or greater than a label step (21) defined as the distance along the web (103) between the front of one label (101) and the front of the label (101) consecutive to it.

6. The device according to claim 1, characterised in that the detaching unit (12) comprises an inversion plate (33) comprising a first surface (34) and a second surface (35) which are opposite to one another and form part of the movement path of the web (103); said inversion plate (33) comprising a detaching edge (36) positioned between the first surface (34) and the second surface (35) for causing the release of each label (101) as the web (103) passes from the first surface (34) to the second surface (35).

7. The device according to claim 1, characterised in that the feed means (28) comprise a sending roller (29) for storing the web (103) to be fed along the movement path and a receiving roller (30) for receiving the web (103) once the labels (101) have been detached, wherein the movement path extends from the sending roller (29) to the receiving roller (30).

8. The device according to claim 7, characterised in that the device comprises guide means (31) positioned along the movement path for guiding the web (103) from the sending roller (29) to the detaching unit (12) and from the detaching unit (12) to the receiving roller (30).

9. The device according to claim 8, characterised in that the guide means (31) comprise a tensioning unit (13) extending between its own first end (4) rotatably mounted on the supporting body (3) and its own second end (5) forming a web (103) guide; said tensioning unit (13) comprising an elastic device operatively connected between the supporting body (3) and the rest of the tensioning unit (13) and designed to keep the web (103) under tension.

10. The device according to claim 7, characterised in that the feed means (28) comprise a feed roller (10) positioned in contact both with an outward stretch of the web (103) and with a return stretch of the web (103) where the outward stretch and the return stretch are respectively defined as the stretch of the web (103) between the sending roller (29) and the detaching unit (12) and between the latter and the receiving roller (30); said feed means (28) comprising approach units (11) positioned around and close to at least part of the feed roller (10) and defining a passage adjacent to the feed roller (10) for bringing the web (103) into contact with the feed roller (10).

11. A machine for processing containers (2), comprising:

feed means for feeding the containers along a container movement path;

a labelling unit positioned at a stretch of said container movement path and operatively associated with the feed means for applying labels (101) to the moving containers (2);

characterised in that the labelling unit comprises a device for applying self-adhesive labels (101) according to claim 1.

12. A method for applying self-adhesive labels (101) on moving containers (2) on a machine, the labels (101) being provided on a web (103), the web (103) and labels (101) being involved in a continuing series of movement cycles wherein, at a beginning of a first movement cycle, a front of a first label (101) on the web (103) is provided at a predetermined initial position which is in register with the containers (2) on the machine and in the first movement cycle the front of the first label (101) starts from the predetermined initial position and at the end of the first movement cycle a front of a next label is located at the predetermined initial position, the method comprising the following operating steps:

feeding the web (103) on which the labels (101) are positioned in an outward direction (19) of a movement path in such a way as to bring one label (101) at a time to a detaching zone (105); said step of feeding the web (103) comprising bringing the web (103) up to a predetermined speed which is substantially equal to a speed of movement of a container (2) at the detaching zone (105);

detaching the label (101) at the detaching zone (105) and synchronised with the arrival of a container (2) at the detaching zone (105), in such a way as to apply the label (101) to the container (2);

characterised in that, after the label (101) has been detached, the method comprises a step of moving the front of the next label (101) on the web (103) in a return direction (20), opposite to the outward direction (19), by a preselected distance from the predetermined initial position, which step of moving increases a movement space between the front of the next label (101) and the detaching zone (105) by a predetermined amount, wherein the preselected distance from the predetermined initial position is a distance which is effective to (a) reduce a maximum acceleration of the next label (101) to the detaching zone (105) below a preselected amount, or (b) reduce a maximum deceleration of the web (103), after the next label (101) is detached, below a preselected amount, or (c) both (a) and (b).

13. The method according to claim 12, characterised in that the sum of the duration of the step of moving the web (103) in the outward direction (19) and the duration of the step of moving the web (103) in the return direction (20) is less than or equal to a predetermined machine step time and less than or equal to the period of time between the passage of one container (2) and a container consecutive to it at the detaching zone (105).

14. The method according to claim 12, characterised in that the step of moving the web (103) in the outward direction (19) comprises the following sub-steps:

accelerating the web (103) until it reaches the predetermined speed and keeping it at said predetermined speed for a predetermined space for application of the label (101);

decelerating the web (103) until it reaches a null speed.

* * * * *